United States Patent [19]

Davis

[11] 4,013,225

[45] * Mar. 22, 1977

[54] EXTENSION SPRAY GUN

[76] Inventor: J. C. Davis, 9818 Hathaway, Dallas, Tex. 75220

[ * ] Notice: The portion of the term of this patent subsequent to Oct. 28, 1992, has been disclaimed.

[22] Filed: Aug. 25, 1975

[21] Appl. No.: 607,717

Related U.S. Application Data

[63] Continuation-in-part of Ser. No. 464,992, April 29, 1974, Pat. No. 3,915,382.

[52] U.S. Cl. ..... 239/195; 239/281; 239/532; 239/533.1

[51] Int. Cl.[2] ..... B05B 15/00

[58] Field of Search ..... 239/195, 280, 280.5, 239/281, 532, 533, 574

[56] References Cited

UNITED STATES PATENTS

| | | | |
|---|---|---|---|
| 2,122,559 | 7/1938 | Dapero et al. | 239/532 X |
| 3,645,450 | 2/1972 | Calder | 239/532 X |
| 3,813,044 | 5/1974 | Westenberger | 239/533 |
| 3,915,382 | 10/1975 | Davis | 239/195 |

FOREIGN PATENTS OR APPLICATIONS

| | | | |
|---|---|---|---|
| 652,781 | 2/1963 | Italy | 239/281 |

*Primary Examiner*—John J. Love
*Attorney, Agent, or Firm*—Howard E. Moore; Gerald G. Crutsinger

[57] ABSTRACT

An extension spray gun comprising a plurality of hollow pole sections telescopically secured together to form an extendable pole having a spray nozzle secured to one end of the pole and a valve secured to the other end of the pole to control flow of paint through a flexible hose extending between the valve and the nozzle. Paint is delivered from the hose to a chamber formed in the nozzle and flows through a passage in the nozzle to a spray tip. A valve element in the chamber is spring urged to close the passage when pressure of paint in the chamber is less than a predetermined pressure.

10 Claims, 7 Drawing Figures

EXTENSION SPRAY GUN

CROSS-REFERENCE TO RELATED APPLICATION

This application is a continuation-in-part of my copending application Ser. No. 464,992, filed Apr. 29, 1974 entitled "Extension Spray Gun" now U.S. Pat. No. 3,915,382.

BACKGROUND OF THE INVENTION

Airless type paint spray guns are connected to pumps which deliver paint at pressures of, for example, 1,200 – 3000 pounds per square inch through a spray tip or nozzle.

Heretofore, in order to reach high overhead locations, the painter has erected scaffolds which required a great deal of time and labor. Expense involved in acquiring, transporting, erecting and disassembling scaffolds in often a major portion of the total cost of a painting project.

Ladders may be used to reach high locations but only allow the painter to reach a limited area before moving the ladder.

Heretofore, no extension spray gun has been developed that is readily extendable and has a fully adjustable spray nozzle with all the capability of a regular spray gun and a shut off valve to prevent dripping.

SUMMARY OF INVENTION

The extension spray gun disclosed herein is used for spraying paint, varnish, shellac, and the like, and is readily extendable and fully adjustable to reach high overhead locations.

The apparatus basically comprises a pole, which is telescopically extendable, having a locking device to lock it at any length desired; a spray nozzle pivotally connected to one end of the pole; and a valve located at the other end of the pole with a flexible hose extending between the valve and spray nozzle. The spray nozzle is adapted for use with standard spray tips and therefore has all of the capabilities of a regular spray gun. The flexible hose permits adjustment of the length of the pole without elaborate seal and swivel mechanisms employed in extension guns heretofore devised.

A second embodiment of the extension spray gun has a pressure relief valve to prevent dripping when pressure is reduced. The valve comprises a piston slideably disposed in a chamber of the spray nozzle. The piston has a tip which is disposed in the valve seat when the piston is urged toward the spray tip. An adjustable spring urges the piston forward. The chamber communicates with a high pressure hose such that when the spray valve is opened and fluid above a predetermined pressure enters the chamber the fluid exerts a force on the piston to move the piston away from the valve seat to allow the fluid to pass through the spray tip.

A primary object of the invention is to provide a shut off valve on a spray gun used to reach high overhead areas to prevent dripping of paint onto the area below the surface being painted.

Another object of the invention is to provide an attachment for a conventional spray gun to eliminate the necessity for ladders and scaffolding thus reducing the time required to paint an overhead area.

A further object of the invention is to provide a spray shut off valve which is readily adjustable to vary the minimum pressure to open the valve to adjust for different liquids used in the spray gun.

A further object of the invention is to provide an adjustable mounting for a pole supported spray nozzle which may be pointed at varying angles relative to the pole.

A still further object of the invention is to provide an extension for a spray gun having a flexible connection between a spray nozzle and a control valve such that the length of the extension is readily adjustable without change of equipment or use of tools.

Other and further objects of the invention will become apparent upon referring to the detailed description hereinafter following and to the drawings annexed hereto.

BRIEF DESCRIPTION OF THE DRAWINGS

Drawings of a preferred embodiment of the invention are annexed hereto so that the invention may be better and more fully understood, in which:

FIG. 6 is a fragmentary and partially sectionalized elevational view of a modified form on the spray head.

DESCRIPTION OF A FIRST EMBODIMENT

Figure 1:
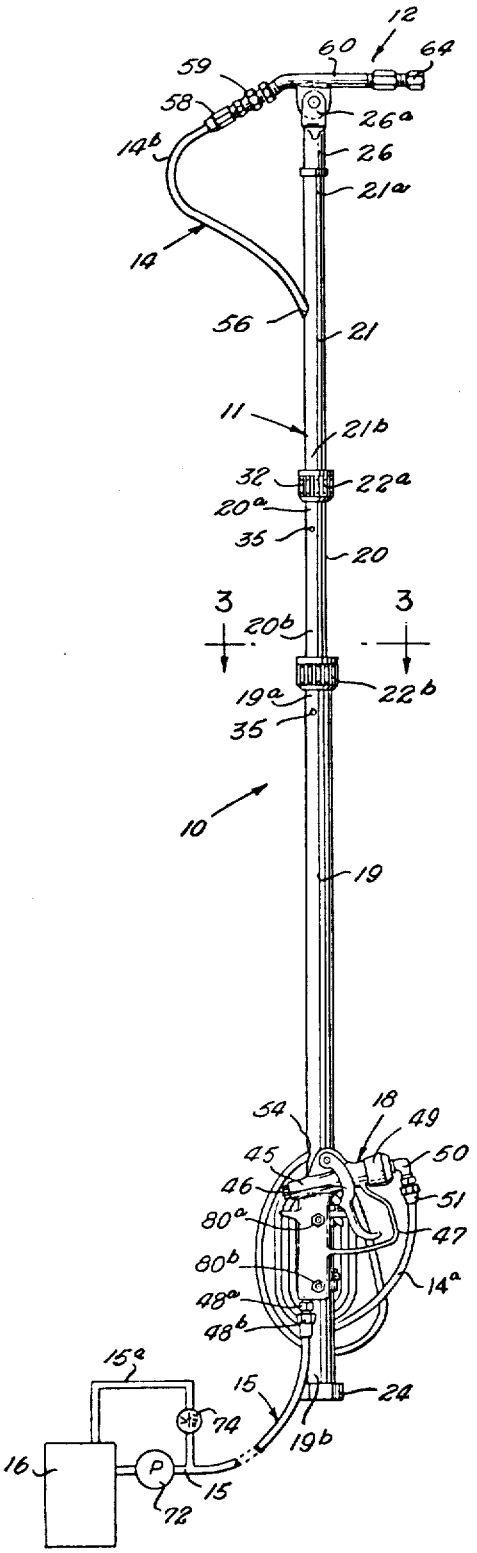
FIG. 1 is a front elevational view of the extension spray gun.
Figure 2:
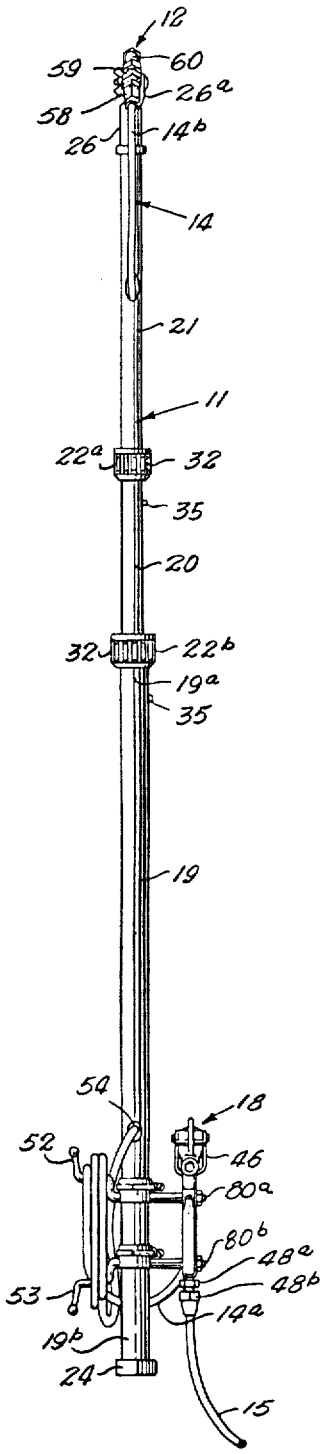
FIG. 2 is a side elevational view.

Referring to FIGS. 1 and 2 of the drawing, the numeral 10 generally designates an extension spray gun having a telescopic pole 11, a nozzle spray head 12, a valve 18 attached adjacent the lower end of the pole 11, and a flexible hose 14 having a first end **14*a* connected to control valve 18 and a second end 14*b* connected to nozzle spray head 12**.

Pole 11 comprises a plurality of hollow pole sections 19, 20, and 21 secured together by locking devices **22*a* and 22*b* for adjustment of the length of pole 11; and an adapter 26 secured to the upper end of pole 11. As will be hereinafter more fully explained, pole 11 may be shortened to substantially the length of base pole section 19 by sliding intermediate section 20 into base section 19 and end pole section 21 into intermediate pole section 20 and tightening locking devices 22*a* and 22*b*. The pole 11 may be extended to full length by pulling out sections 19, 20, and 21**.

Figure 4:
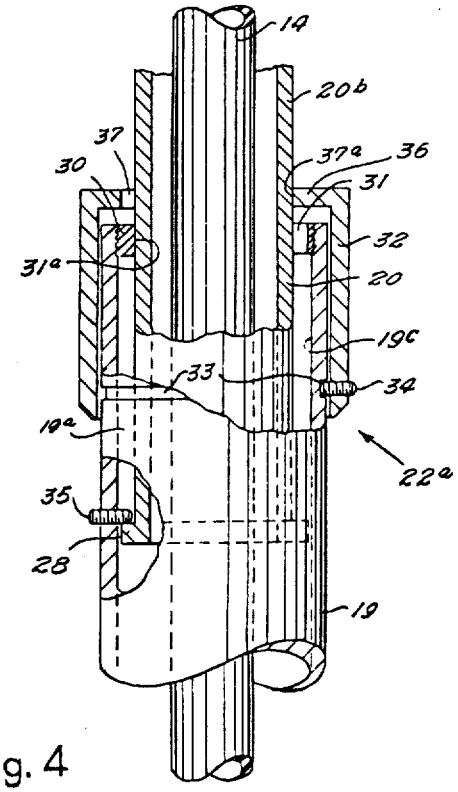
FIG. 4 is a cross-sectional view taken along line 4—4 of FIG. 3.
Figure 7:
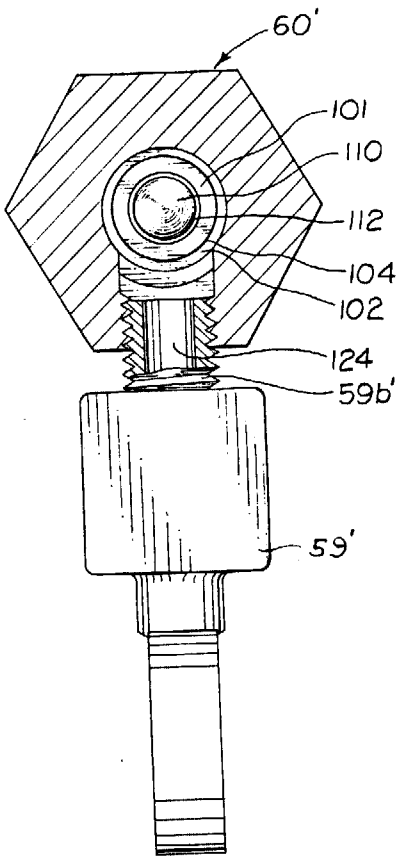
FIG. 7 is a cross-sectional view taken along line 7—7 of FIG. 6.
Figure 9:
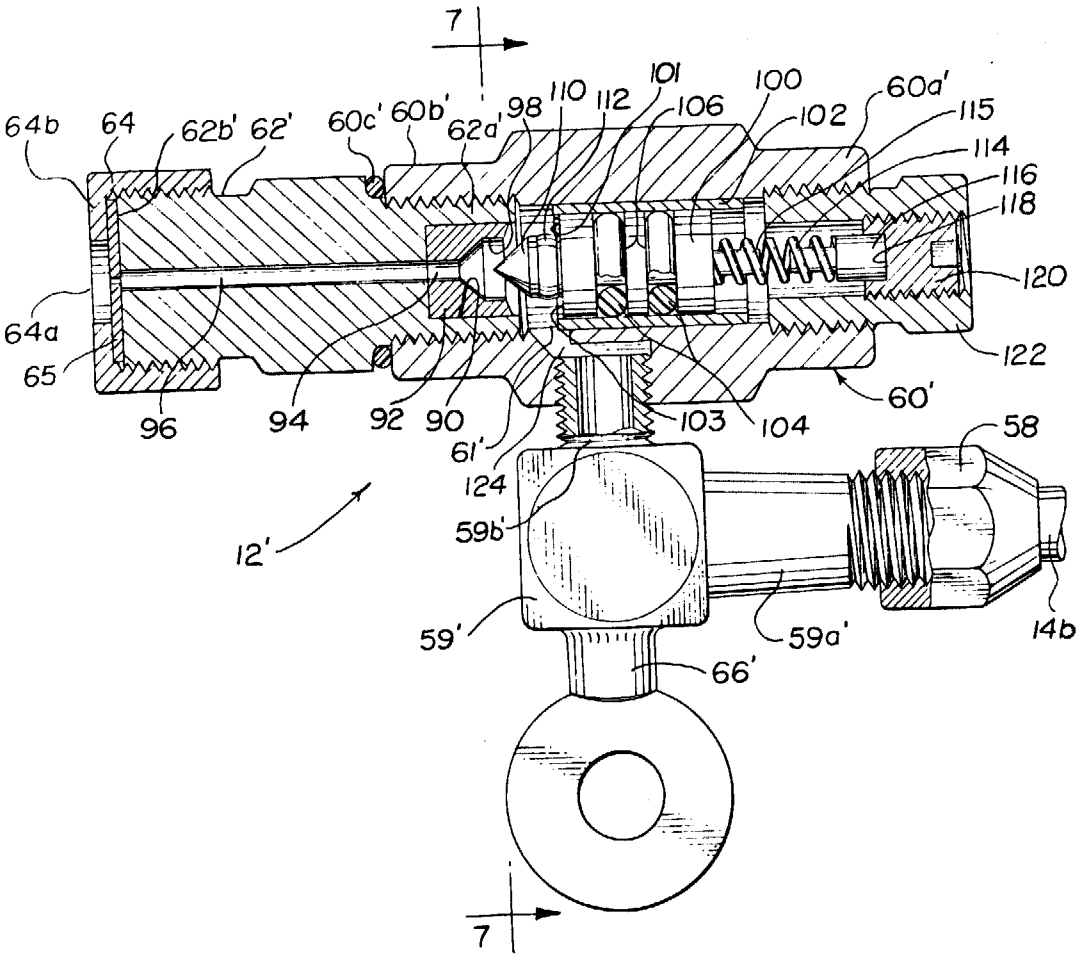

As best illustrated in FIG. 4 of the drawing, a spacer flange 28 is secured to the end **20*b* of intermediate pole section 20 and is slidably disposed in the bore 19*c* extending through hollow base section 19 of the pole 11**.

Internal threads are preferably formed in the end 19a of the base section 19 to removably secure a circular plate 30 in bore **19*c*. The circular plate 30 has an aperture 31 extending therethrough which is preferably eccentric to the outer periphery of circular plate 30**, as will be hereinafter more fully explained.

Locking devices **22*a* and 22*b* are preferably of substantially identical construction and each comprises a tubular collar 32 having an end plate 36 secured to one end thereof. The end plate 36 has an aperture 37 extending therethrough which is eccentric to the inner wall of the collar 32. The end 20***b* of intermediate section 20 extends through apertures 31 and 37 and the end 19*a* of base section 19 extends into tubular collar 32.

It should be readily apparent that rotation of collar 32 will result in movement of apertures 31 and 37 into or out of axial alignment.

Apertures 31 and 37 preferably have a diameter slightly greater than the outside diameter of intermediate section 20, permitting axial movement of section 20 when apertures 31 and 37 are axially aligned. However, movement of aperture 37 out of axial alignment with aperture 31 will move surfaces 31*a* and 37*a* into frictional engagement with the outer surface of intermediate section 20 of pole 11 such that sections 19 and 20 of pole 11 are restrained against relative movement.

The end 19*a* of base section 19 has a groove 33 formed in the outer surface thereof into which the end of set screw 34 extends. Set screw 34 is threadedly secured through the wall of collar 32 to limit movement of collar 32 longitudinally of base pole section 19.

The locking devices 22*a* and 22*b* are preferably adapted to permit longitudinal adjustment of sections 19, 20, and 21 while providing rigidity between the sections to prevent excessive flexure of the pole 11. As illustrated in FIG. 4 a set screw 35 extends through the wall of the base section 19 to limit movement of intermediate section 20 through the bore 19*c*. It should be appreciated that limiting spacing between spacer flange 28 and plate 30 provides rigidity between sections 19 and 20 of pole 11.

Valve 18 is a normally closed adjustable orifice type valve having a trigger 46 and trigger guard 47.

Valve 18 may assume any desired configuration such as that employed in conventional spray guns of the type manufactured by Spray Systems Company of Bellwood, Illinois or Nordson Corporation of Amherst, Ohio. However, if a conventional spray gun is employed to provide a control valve mechanism, the spray tip should be removed from the spray gun.

Valve 18 is secured by a suitable coupling to the end 14*a* of hose 14. In the illustrated embodiment of the invention, the coupling comprises a male connector member 50 threadedly secured to valve 18. A female connector member 51 is secured to the end 14*a* of hose 14 and is threadedly secured to male connector 50.

The end 14*b* of hose 14 has a female connector 58 secured thereto which is connectable to male connector 59 secured to nozzle spray head 12.

As best illustrated in FIG. 1, base pole section 19 has a passage 54 extending through the wall thereof through which hose 14 extends. Hose 14 extends longitudinally through bores 19c, 20c and 21c of pole sections 19, 20 and 21, respectively, and through passage 56 formed in the wall of end pole section 21.

Hose 14 preferably has a length exceeding the length of pole 11 when all of the pole sections 19, 20, and 21 are fully extended. When pole sections 19, 20 and 21 are retracted to shorten pole 11, the excess length of hose 14 is drawn through passage 54 and coiled around lugs 52 and 53 secured to base pole section 19.

Figure 5:
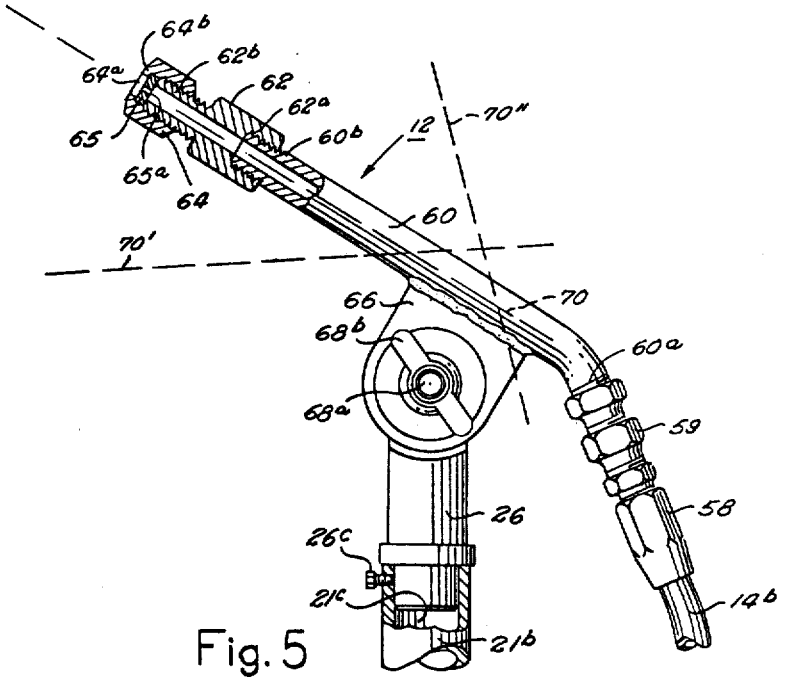
FIG. 5 is a fragmentary elevational view of the nozzle head, parts being broken away to more clearly illustrate the details of construction.
Figure 3:
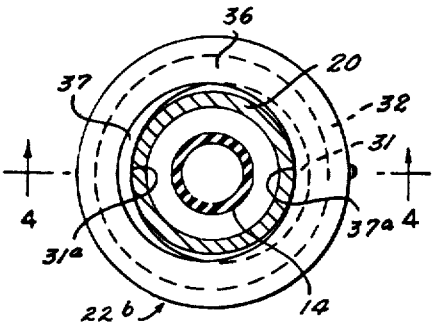
FIG. 3 is a cross-sectional view taken along line 3—3 of FIG. 1.

As illustrated in FIG. 5, the nozzle spray head 12 comprises a hollow tubular body 60 having a deflected end portion 60*a* secured to connector 59 which is connectable to the female connector 58 secured to the end 14*b* of hose 14. End 60*b* of body 60 is externally threaded and extends into the female end 62*a* of tip adaptor 62. Tip adapter 62 has an externally threaded male portion 62*b* to which internally threaded tip cap 64 is threadedly secured.

Tip cap 64 has a passage 64*a* formed in the end thereof forming a shoulder 64*b* engaging one side of orifice plate 65 which is urged into sealing engagement with the end 62*b* of tip adapter 62.

The orifice plate 65 has an aperture 65*a* extending therethrough.

Tubular body 60 has an outwardly extending ear 66 welded or otherwise rigidly secured thereto intermediate opposite ends thereof. Ear 66 has an aperture extending therethrough and is pivotally attached to adapter 26 by adjustable means such as bolt 68*a* and wing nut 68*b* such that the axis 70 of tubular body 60, as shown by the dashed line, may be moved at any angle between the position shown by the dashed line 70' and the position by the dashed line 70'' making the nozzle head completely adjustable to any spray angle desired.

The adapter 26 has a flattened end 26*a* forming a lug having an aperture through which bolt 68*a* extends. The lower end 26*b* of adapter 26 extends into bore 21*c* of end section 21 and is restrained against movement by set screw 26*c*.

Extension spray gun 10 is connected by hose 15 to paint supply 16 having a pump 72 for pumping the paint from paint supply 16 through hose 15 to control valve 18. A pressure relief valve 74 is positioned between pump 72 and control valve 18 of extension spray gun 10 such that when valve 18 is closed back pressure is relieved through valve 74 and paint is recirculated to paint supply 16 through hose 15*a*.

DESCRIPTION OF A SECOND EMBODIMENT

The end 14*b* of hose 14 has a female connector 58 secured thereto which is connected to threaded extension 59*a'* on L-shaped connector 59' of nozzle spray head 12'.

It should be readily apparent that hose 14 is of a flexible material such that when pressures of 2000 – 5000 psi are applied internally, the hose 14 stretches or expands outwardly. When pressure is reduced the hose 14 contracts.

As illustrated in FIG. 6, the nozzle spray head 12' comprises a hollow body 60' having a chamber 61' formed therein. Body 60' is threadedly engaged with end 59*b'* of L-shaped connector 59' such that chamber 61' communicates with hose 14. End 60*b'* of body 60' is internally threaded to receive tip adapter 62'. An O-ring seal 60*c'* is positioned between a shoulder on tip adapter 62' and end 60*b'* on body 60' to prevent leaks.

Tip adapter 62' has a cavity 90 formed in end 62*a'* thereof to receive valve seat 92 which has a passage 94 communicating with passage 96 in tip adapter 62. Passage 94 has a conical shaped cavity 98 formed adjacent the chamber 61'.

A piston 100 is slideably disposed in sleeve 102 which is longitudinally disposed in chamber 61'. The piston 100 has seal means such as two spaced O-rings 104 positioned in grooves 106 formed in the piston 100.

The piston 100 has a diameter larger than that of conical shaped cavity 98 such that when piston 100 is urged forwardly toward end 60*b'* an annular area 101 of piston face 103 remains exposed to chamber 61'. Piston 100 has a conical shaped tip 110 axially aligned with conical shaped cavity 98, the tip having seal means such as O-ring 112 such that when the piston 100 is urged toward end 60b' O-ring 112 will seal against the sides of conical cavity 98 to prevent passage of fluid to passage 96.

Piston 100 is urged closed toward end 60b' by spring 114 which is disposed on rod 115 rigidly secured to piston 100 and spring push rod 116. Rod 116 preferably has a rounded head slideably disposed in pocket 118 of adjusting screw 120. Adjusting screw 120 is threadedly engaged to adjustment housing 122 which is threadedly engaged to end 60a' of body 60'. By moving adjusting screw 120 toward end 60b', spring 114 exerts a greater force on piston 100 and therefore a greater pressure from the fluid is required to open piston 100.

Passage 124 connects chamber 61' with L-shaped connector 59' such that when a fluid under a pre-determined amount of pressure is pumped through hose 14 upon opening valve 18 the pressurized fluid will exert a force on annular area 101 of piston 100 greater than that pressure of spring 114 to force piston 100 toward end 60a' of body 60' to open passage 96 and allow spraying of fluid from tip cap 64.

L-shaped connector 59' has an outwardly extending ear 66' welded or otherwise rigidly secured thereto intermediate opposite ends thereof. Ear 66' has an aperture extending therethrough and is pivotally attached to adapter 26 by adjustable means such as bolt 68a and wing nut 68b.

Operation of the invention heretofore described is as follows:

Adjustment of spray nozzle 12 may be accomplished by loosening the wing nut 68b and moving the spray head 12 to the desired angle and then retightening the wing nut 68b.

The desired heighth is obtained by rotating collar 32 of locking device 22a to release end section 21 and moving end section 21 to the desired position then retightening collar 32. If additional heighth is desired, section 20 may be extended by rotating locking device 22b; extending intermediate section 20 and retightening locking device 22b. As additional heighth is needed hose is taken off lugs 52 and 53 and urged through passage 54 into the bore 19c extending through base pole section 19.

The extension spray gun 10 is then connected to a conventional pressurized paint supply 16. The extension spray gun 10 is then gripped with one hand about valve 18 for controlling movement of trigger 46 and another hand at the middle of base section 19 of pole 11.

On modified spray head 12', when valve 18 is opened, pressurized fluid is delivered through hose 14, through connector 59' and through passage 124 to chamber 61'. The fluid will exert a force on area 101 of piston 100, moving the piston 100 toward end 60c' of body 60' to open passages 94 and 96. The fluid passes through passage 96 to orifice plate 65 where it is atomized to be sprayed from the nozzle 12'.

When valve 18 is closed and the pressure drops below that pressure necessary to effectively spray the fluid (this pressure depends on the fluid and type of spray tip) spring 114 moves piston 100 toward end 60b' of body 60' to urge tip 110 into conical cavity 98 to close passage 96 preventing drip of paint from tip 64 of nozzle 12'.

From the foregoing it should be readily apparent that the preferred embodiment herein described accomplishes the objects of the invention hereinbefore discussed.

It should be appreciated that other and further embodiments of the invention may be devised without departing from the basic concept thereof.

Having described my invention, I claim:

1. A shut off valve on an extension spray gun comprising: a plurality of hollow pole sections, each of said pole sections having a bore extending therethrough; means telescopically securing each said pole section to another pole section; a flexible hose extending through the bore in said hollow pole sections; spray valve means; means to secure said spray valve means to one of said pole sections; a spray nozzle having a chamber formed therein; means to secure said spray nozzle to the outer end of another pole section; means to secure a first end of said hose to said spray valve means; means to secure a second end of said hose to said chamber in said spray nozzle; means to deliver pressurized fluid to said spray valve; a piston slideably disposed longitudinally in said chamber; a tip adapter having a passage defined longitudinally therethrough and a seat positioned to receive one end of said piston; means to secure said tip adapter to an end of said spray nozzle; a spray tip secured to said tip adapter; means to urge said piston against said seat to close said passage in said tip adapter when pressure in said chamber is reduced to prevent leakage upon constriction of said flexible hose when the fluid is not of sufficient pressure to be atomized by the spray tip; and an area of said piston on the end adjacent said seat exposed to said chamber such that when fluid of a pre-determined pressure sufficient to be atomized is delivered to said chamber, the force against said area will move said piston off of said seat, opening said passage.

2. The combination called for in claim 1 wherein the means to urge said piston against said seat comprises a spring; and screw means threadedly engaged to said body to adjustably urge said spring against said piston to adjust the force necessary to move said piston from said seat.

3. The combination called for in claim 1 wherein said piston has a conical shaped tip on the end adjacent said seat; and seal means on said tip to seal between said seat and said tip on said piston.

4. The combination called for in claim 3 wherein said seat has a conical shaped cavity to receive said tip on said piston.

5. An extension spray gun comprising: a plurality of tubular pole sections having a bore extending longitudinally therethrough, said tubular pole sections having first and second passages formed therein communicating with said bore; a spray head; means to secure said spray head to one of said tubular pole sections; valve means; means to secure said valve means to one of said tubular pole sections; a flexible conduit having resilient walls extending into said first passage, through said bore, and out of said second passage; means to secure a first end of said flexible conduit to said spray head; means to secure a second end of said flexible conduit to said valve means; means to deliver pressurized fluid to said valve means; a circular plate having an aperture which is eccentric to the outer periphery of said circular plate; means securing said circular plate in the bore of a first of said pole sections; a tubular collar having a bore formed therein; an end plate on said collar, said end plate having an aperture which is eccentric to the bore in the tubular collar; wherein an end of said first pole section extends into the bore in said tubular collar; wherein an end of a second of said pole sections extends through the aperture in the end of the tubular collar and through the aperture in the circular plate such that upon rotation of said tubular collar said end plate will frictionally engage said second pole section; and a valve means in said spray head arranged to shut off flow of fluid when the pressure drops below a predetermined amount to prevent constriction of said flexible conduit from forcing fluid from said spray head.

6. The combination called for in claim 5 wherein the valve means comprises: a hollow body having a chamber defined therein; means to deliver pressurized fluid to said chamber; a piston slideably disposed in said chamber; seal means positioned between said piston and said chamber; a tip adapter having a seat formed therein to receive said piston and a passage formed therethrough; means to urge said piston against said seat to close said passage in said tip adapter; and an exposed area on said piston being exposed to a portion of said chamber adjacent said seat such that when fluid is delivered to said chamber at a pre-determined pressure, the fluid exerts a force against said exposed area to overcome the force of said means to urge said piston against said seat, opening the passage in said tip adapter.

7. The combination called for in claim 6 wherein the means to urge said piston against said seat comprises a spring; and screw means threadedly engaged to said body to adjustably urge said spring against said piston to adjust the force necessary to move said piston from said seat.

8. The combination called for in claim 6 wherein said piston has a conical shaped tip on the end adjacent said seat; and seal means on said tip to seal between said seat and said tip on said piston.

9. The combination called for in claim 8 wherein said seat has a conical shaped cavity to receive said tip on said piston.

10. An extension spray gun comprising: a control valve; means to connect said control valve to a source of pressurized fluid; a tubular body having a cavity formed therein; an orifice plate having a passage therethrough secured to a first end of said tubular body; a plurality of hollow pole sections, each of said pole sections having a bore extending therethrough; means to secure said control valve to one of said hollow pole sections means telescopically securing each said pole section to another pole section; means pivotally securing said tubular body to an end of one of said pole sections; a flexible hose extending through the bore in said hollow pole sections; means to secure a first end of said flexible hose to a second end of said tubular body to communicate with said cavity, means to secure a second end of said flexible hose to said control valve; a piston slideably disposed in said cavity; a seat positioned between said passage in said orifice plate and said piston, means to urge said piston into said seat to close said passage in said orifice plate when the pressure of said fluid in said hose drops below a predetermined amount; and an annular area on said piston adjacent said seat, arranged such that said annular area is exposed to said cavity when said piston is urged against said seat to receive force exerted by fluid delivered to said chamber.

* * * * *